US006703576B1

(12) United States Patent
Chou et al.

(10) Patent No.: US 6,703,576 B1
(45) Date of Patent: Mar. 9, 2004

(54) ARC CHUTE WITH VALVE AND ELECTRIC POWER SWITCH INCORPORATING SAME

(75) Inventors: Yu Wei Chou, Moon Township, PA (US); Ramon J. Ojeda, Imperial, PA (US); Raymond P. Gundy, Indiana, PA (US); Joseph B. Humbert, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/365,872

(22) Filed: Feb. 13, 2003

(51) Int. Cl.[7] ..... H01H 33/02
(52) U.S. Cl. ..... 218/157; 218/35
(58) Field of Search ..... 218/147–149, 218/154–157, 15, 34, 35, 38, 40, 41; 335/201, 202

(56) References Cited

U.S. PATENT DOCUMENTS 2,839,641 A * 6/1958 Edmunds ..... 218/149
3,582,966 A * 6/1971 Strobel ..... 218/149
4,620,076 A 10/1986 Mrenna et al.
4,631,376 A 12/1986 Leone
4,650,940 A 3/1987 Grunert et al.
5,317,117 A 5/1994 Bruski et al.
5,493,092 A 2/1996 Rowe
5,589,672 A 12/1996 Uchida et al.
5,753,877 A 5/1998 Hartzel et al.
5,753,878 A 5/1998 Doughty et al.
5,780,800 A * 7/1998 Palmieri et al. ..... 218/147
6,002,313 A 12/1999 Mrenna et al.
6,407,354 B1 6/2002 Turner et al.
6,452,724 B1 9/2002 Hansen et al.

* cited by examiner

*Primary Examiner*—Lincoln Donovan
*Assistant Examiner*—M. Fishman
(74) *Attorney, Agent, or Firm*—Martin J. Moran

(57) ABSTRACT

A main valve for an arc chute is formed by a flexible sheet member that is mounted over a gas opening of the arc chamber structure by extensions on arc plates that form guides received in elongated slots in the ends of the flexible sheet member. The force generated by high pressure gas in the arc chamber on the center of the flexible sheet member causes it to bow allowing arc gases to escape laterally as the ends of the flexible sheet member are drawn towards each other. Flaps formed by slits in the flexible sheet member are deflected by lower pressure gas before the flexible sheet member bows outward.

19 Claims, 5 Drawing Sheets

ARC CHUTE WITH VALVE AND ELECTRIC POWER SWITCH INCORPORATING SAME

BACKGROUND OF THE INVENTION

1. Field of the Invention

This invention relates to apparatus relieving the pressure of arc gases that builds up in arc chutes of electric power switches during current interruption and to electric power switches incorporating such arc chutes.

2. Background Information

Electric power switches in which the contacts are exposed to air and that are designed to open circuits carrying appreciable current typically experience arcing as the contacts separate. These electric power switches, such as for instance, circuit breakers, commonly incorporate arc chutes to help extinguish the arc. Such arc chutes typically comprise a number of electrically conductive plates held in spaced relation around the separating contacts by an electrically insulative housing. The arc transfers to the arc plates where it is stretched and cooled until extinguished. A considerable volume of gas is generated by the arc. The pressure generated by this arc gas must be relieved to avoid catastrophic damage to the switch casing. However, this discharge of the arc gas must be controlled to avoid injury to persons nearby and to prevent phase to ground or phase to phase arcing in multiphase switches. Various arrangements for venting arc gases from electric power switches have been proposed. However, there is still room for improvement.

SUMMARY OF THE INVENTION

This invention is directed to an arc chute with a valve and to electric power switches incorporating such an arc chute. The arc chute comprises an arc chute chamber structure with a gas opening for releasing arc gases generated during contact separation. The valve comprises a flexible sheet member mounted at its two ends to the arc chamber structure to extend over and close the gas opening in the absence of arc gases. At least one of the two ends of flexible sheet member is free to slide along the arc chamber structure and bow the flexible sheet member between the two ends allowing arc gases to pass outward from the gas opening. The electric power switch incorporating this arc chute has a casing with a gas vent through which the arc gases released through the valve pass out of the casing.

More particularly, the invention is directed to an arc chute for an electric power switch that generates arc gases upon opening. The arc chute comprises an arc chamber structure having at least one gas opening for releasing arc gases and a valve. The valve comprises a flexible sheet member having two ends and side edges extending between the two ends, and mounting means mounting the flexible sheet member at the two ends to the arc chamber structure to extend over and close the at least one gas opening in the absence of arc gases. At least one of the two ends of the flexible sheet member is free to slide along the arc chamber structure and bow the flexible sheet member between the two ends allowing arc gases to pass from the gas opening out laterally between the side edges of the resilient member and the arc chamber structure. The mounting means can comprises a guide on the arc chamber structure slideably engaging the at least one end of the sheet member to allow it to slide along the arc chamber structure. The mounting means can further comprise at least one longitudinal slot through the one end of the flexible sheet member. In this case, the guide on the housing slideably engages the longitudinal slot to allow the one end of the flexible sheet member to slide. The mounting means can comprise a pair of laterally spaced longitudinal slots through the one end of flexible sheet member and a pair of guides on the arc chamber structure slideably engaging the pair of longitudinal slots. The second end of the flexible sheet member can be similarly mounted by the mounting means for sliding.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
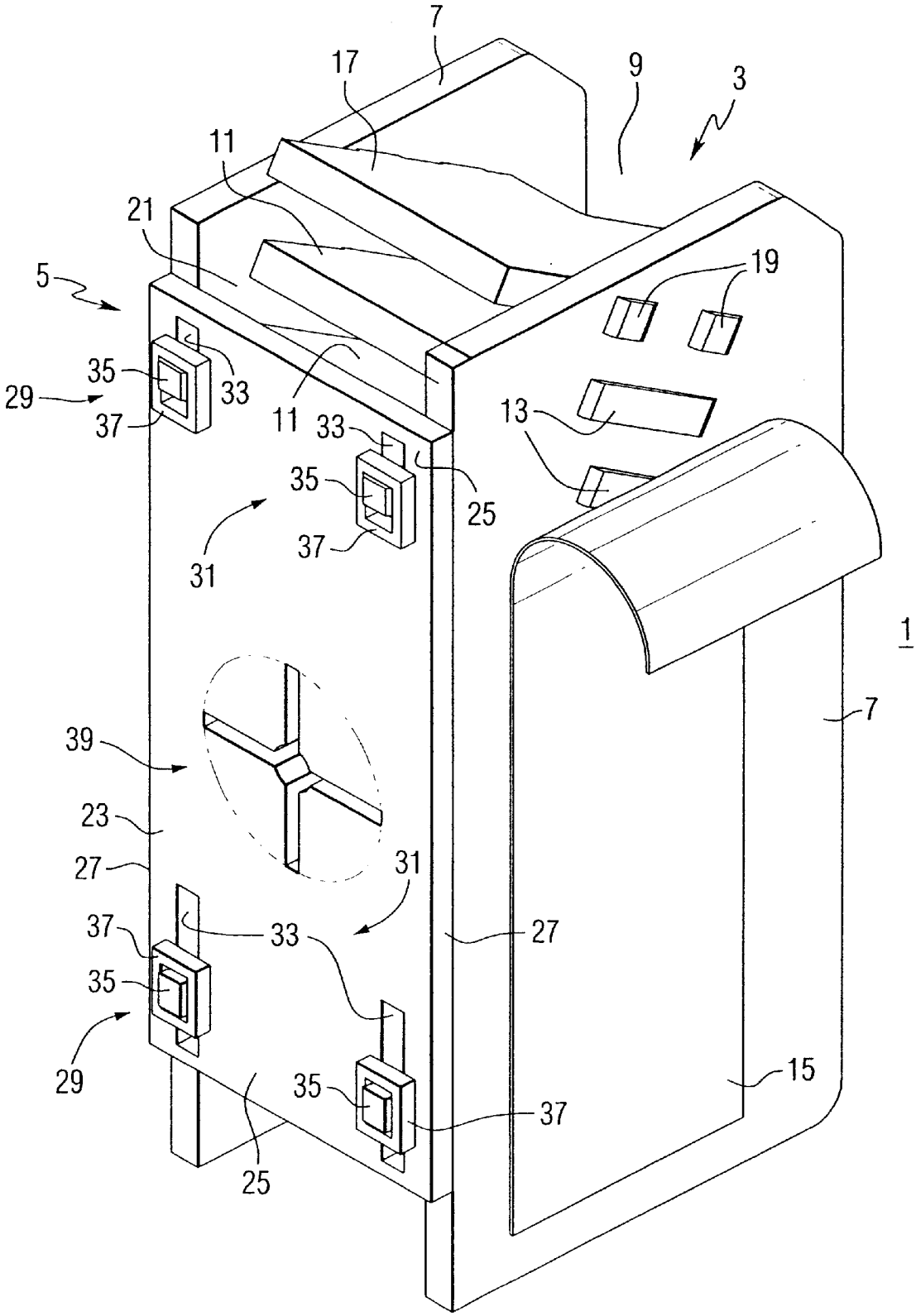
FIG. 1 is an isometric view with part peeled back of an arc chute in accordance with the invention.
Figure 2:
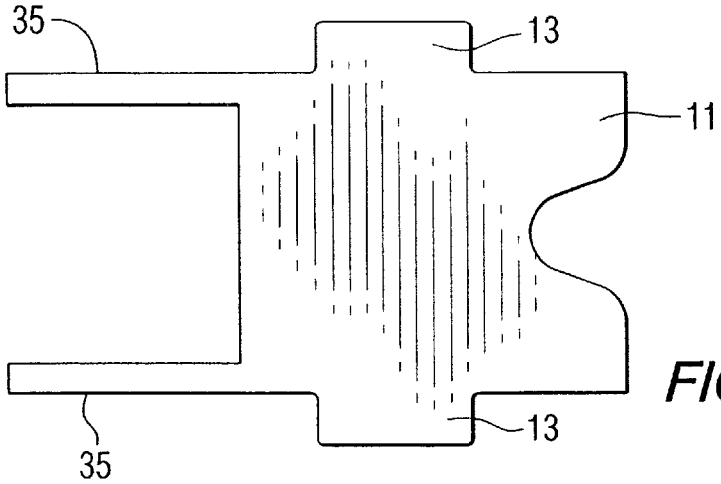
FIG. 2 is a plan view of one of the arc plates which forms part of the arc chute of FIG. 1.
Figure 3:
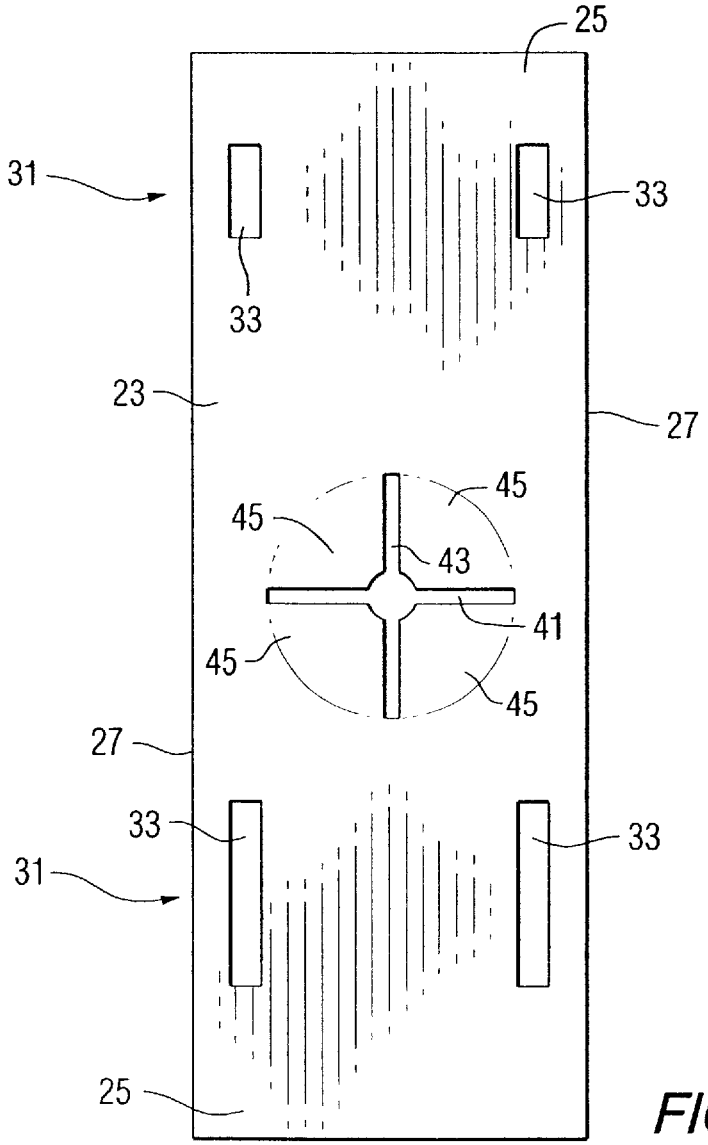
FIG. 3 is a plan view of a flexible sheet member which forms part of the arc chute of FIG. 1.

Referring generally to FIGS. 1–5, an arc chute 1 in accordance with the invention comprises an arc chamber structure 3 and a valve 5. The arc chamber structure 3 is constructed of a pair of electrically insulative sidewalls 7 forming between them an arc chamber 9. A plurality of spaced apart arc plates 11 extend between the sidewalls 7. As is shown in FIG. 2, the arc plates 11 have tangs 13 projecting from either side which extend through openings in the sidewalls 7. These tangs 13 are pinged over to lock the side plates 7 and arc plates 11 together as shown in FIG. 1. The exposed ends of the tangs are covered with an electrically insulative tape 15, shown partially peeled back in FIG. 1 to expose tangs 13. An arc runner 17 is similarly secured between the side plates by pairs of tangs 19. The spaced apart sidewalls 7 form between them a gas opening 21 through which, as will be explained below, arc gases generated in the arc chamber 9 can escape.

The valve 5 is formed by a flexible sheet member 23 having two ends 25 and side edges 27. The flexible sheet member 23 in the exemplary arc chute 1 is made of fish paper. Other suitable flexible materials that are electrically insulative and resistant to the hot gases could also be utilized. The flexible sheet member 23 is mounted over the gas opening 21 by mounts 29. These mounts 29 permit the ends 25 and 27 of the flexible sheet member to slide along the arc chute chamber structure 3 in response to high pressure in the arc chamber 9 causing the flexible sheet member to bow in the middle. The mounts 29 include pairs 31 of elongated slots 33 at the two ends 25 of the flexible sheet member 23. The mounts 29 further include guides projecting from the arc chamber structure 9. In the exemplary embodiment of the invention these guides are in the form of extensions 35 on two of the arc plates 11. These pairs of extensions 35 extend through the elongated slots 33. Retainers 37 are pressed onto the extensions 35 to retain the flexible sheet member while allowing the ends to slide.

Alternatively, just one end of the flexible sheet member 23 could be mounted for sliding while the other end is fixed; however, having both ends free to slide increases the valve action.

The flexible sheet member 23 can also be provided with an auxiliary valve 39 formed by slits in the flexible sheet member 23. The exemplary flexible sheet member 23 is provided with a pair of slits 41 and 43 which intersect intermediate their end points to form four flaps 45.

Figure 4:
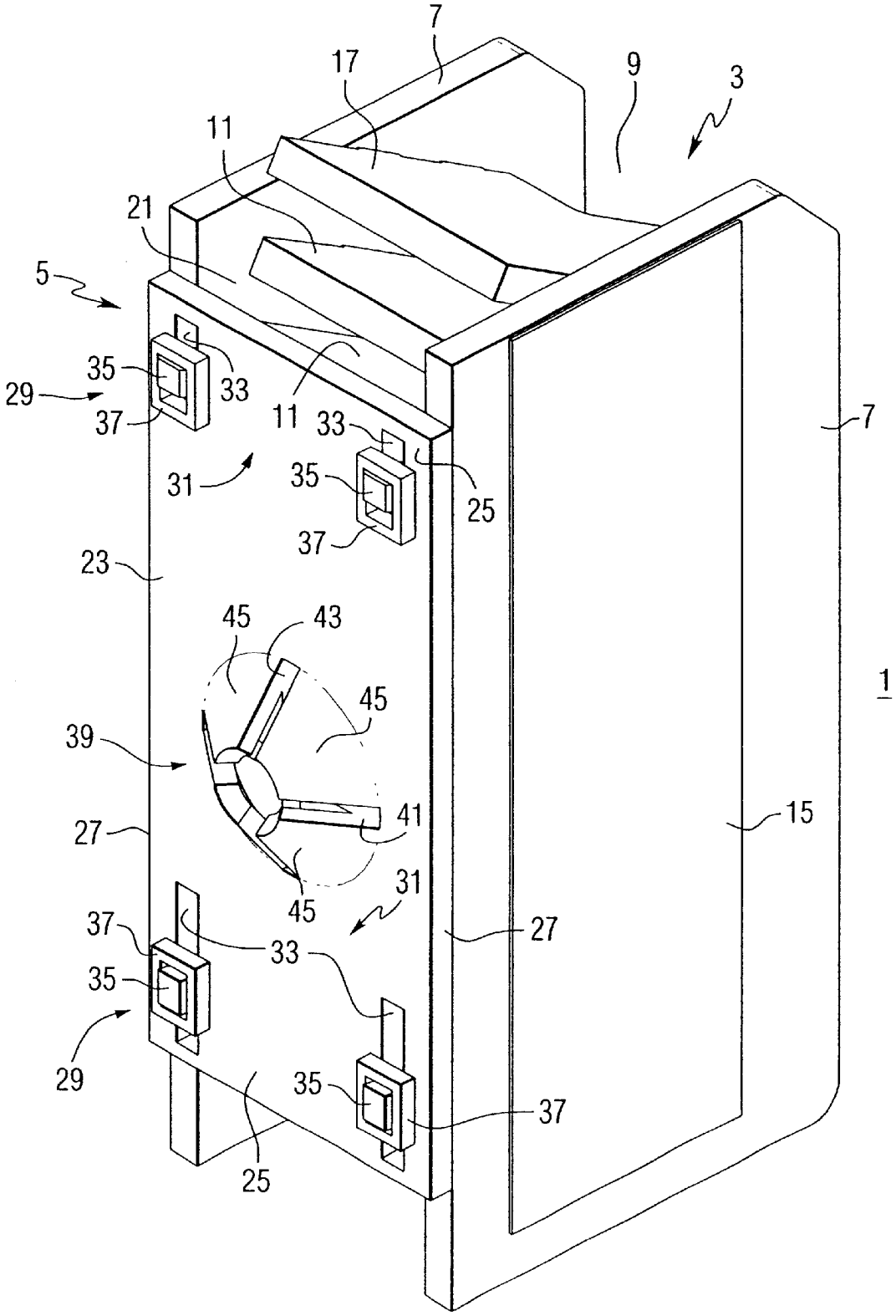
FIG. 4 is an isometric view of the arc chute in accordance with the invention illustrating release of low pressure gas.
Figure 5:
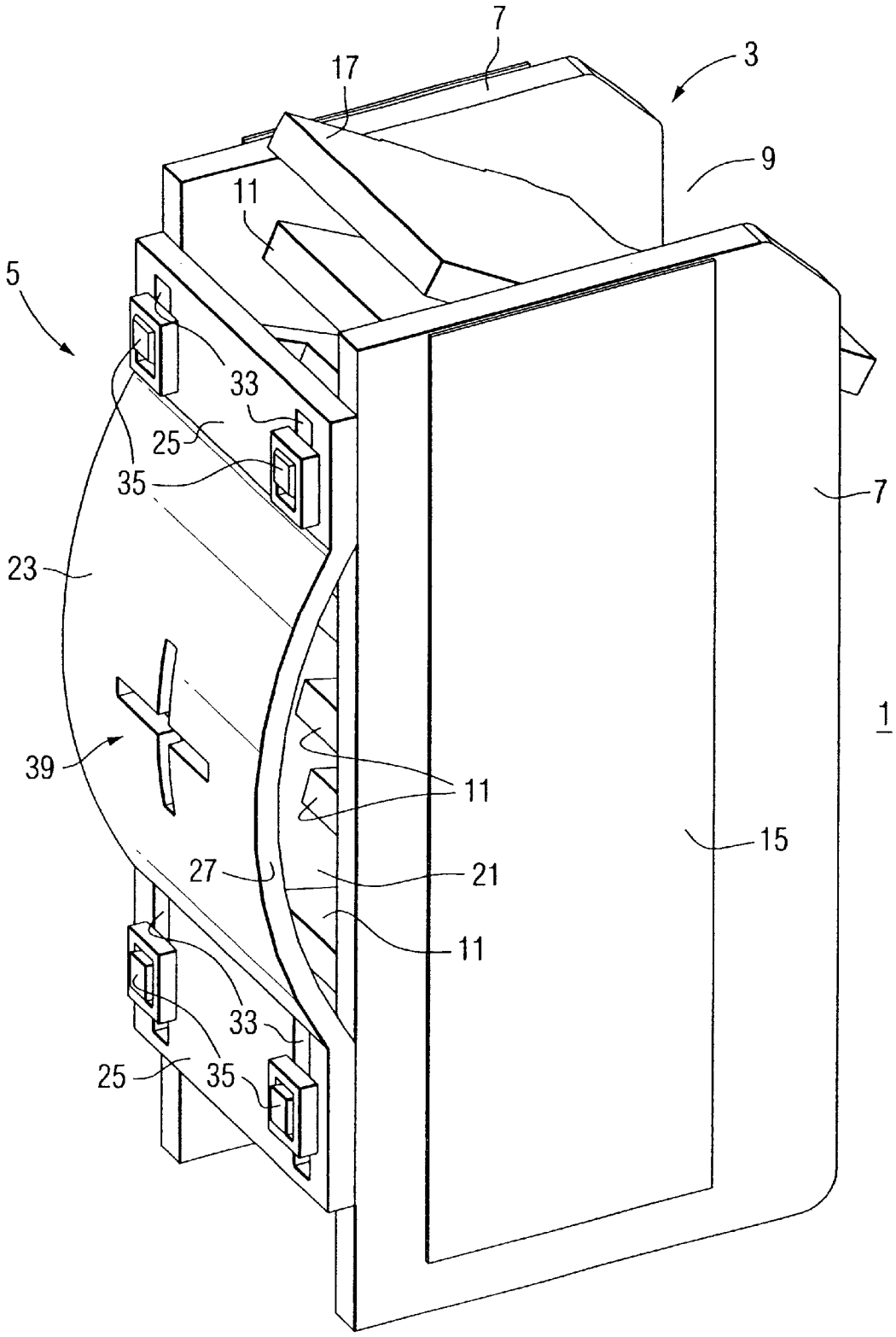
FIG. 5 is an isometric view of the arc chute in accordance with the invention releasing high pressure gas.

FIG. 1 shows the flexible sheet member 23 in the relaxed position flat against the edges of the sidewalls 7 to close the gas opening 21. As gas is generated in the arc chamber 9 during current interruption and the pressure begins to build, the flaps 45 of the auxiliary valve 39 open as shown in FIG. 4 to allow the low pressure gas to escape. As the gas pressure in the arc chamber 9 builds, the pressure exerted against the flexible sheet member 23 causes it to bow, pulling the ends 25 toward each other. As shown in FIG. 5, this allows the higher pressure gas to escape laterally outward between the side edges 27 of the flexible member 23 and the edges of the sidewalls 7 of the arc chamber structure 3. In the exemplary embodiment of the arc chute, the flaps 45 of the auxiliary valve 39 open first before the flexible sheet member 23 begins to bow to any substantial degree.

Figure 6:
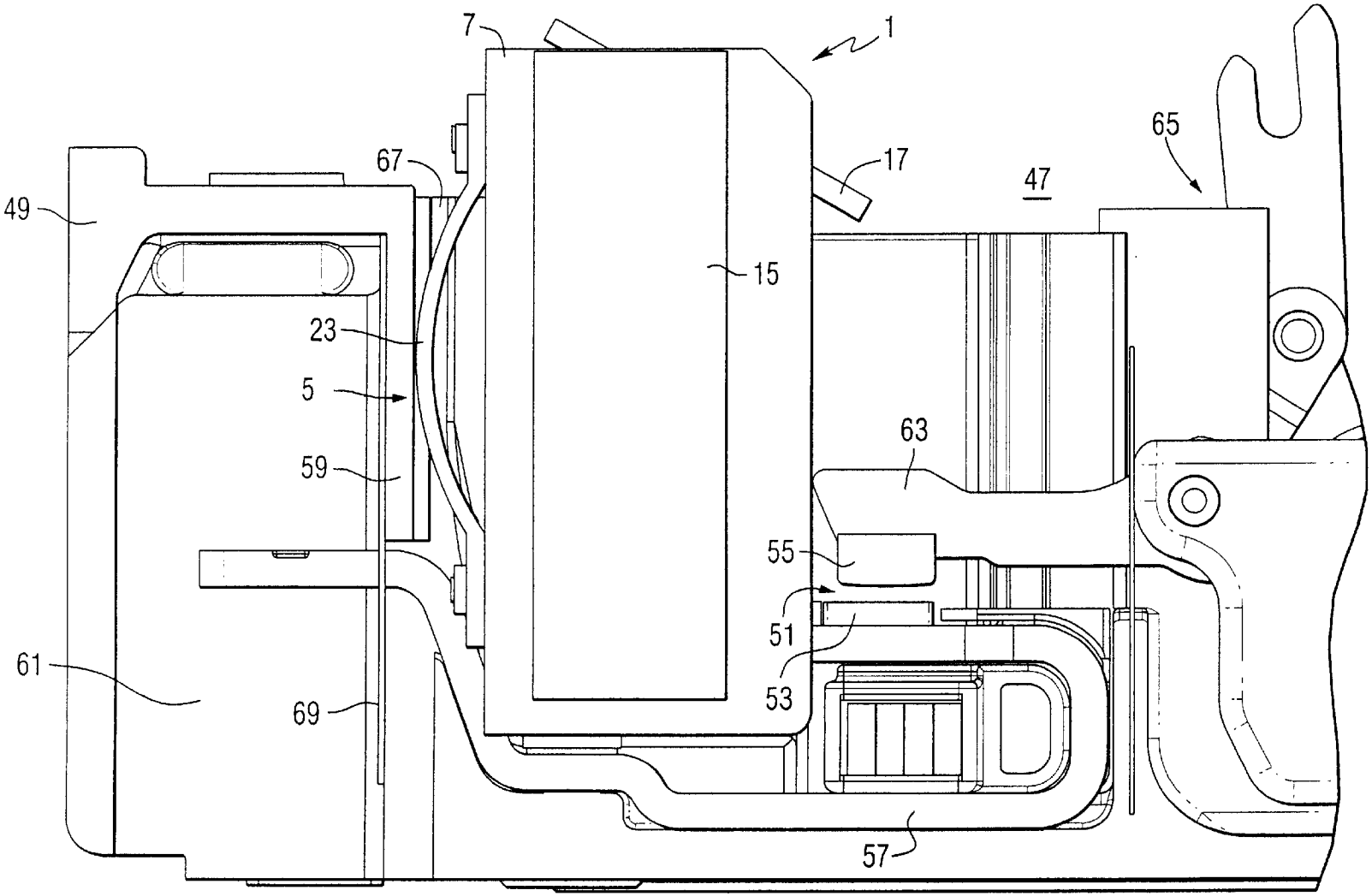
FIG. 6 is a partial vertical sectional view through a circuit breaker incorporating the arc chute of the invention releasing high pressure gas.

The arc chute 1 of the invention is used in electric power switches such as the circuit breaker 47 shown in FIG. 6. This circuit breaker 47 has an electrically insulative casing 49. Only the base of the casing 49 is shown; however, as is well known, the bottom portion has a mating cover. Housed within the casing are separable contacts 51 including a fixed contact 53 and movable contact 55. The fixed contact is secured to a line conductor 57 which extends through an end wall 59 of the casing 49 into a terminal recess 61 where it is connected to an external conductor (not shown). The movable contact 55 is carried by a pivoted movable contact arm 63, which is rotated to open and closed the separable contacts by an operating mechanism indicated generally at 65. As the contacts 51 separate an arc is drawn between the fixed contact 53 and the movable contact 55. This arc must be extinguished in order to interrupt the current. As the movable contact arm 63 fully opens, the arc is driven outward by electromagnetic forces along the arc runner 17 and into the arc chamber 9 where it is stretched and divided by the arc plates 11, shown in FIGS. 1, 4 and 5, until it is extinguished. During this process, a large quantity of arc gas can be generated. The pressure generated by this gas must be relieved to avoid damage to the circuit breaker. The circuit breaker casing 49 is provided with a gas vent 67 which extends vertically behind the arc chute 1. For lower pressure gases, the flaps 45 of the auxiliary valve 39 open, as shown in FIG. 4, to permit gases to pass from the arc chamber 9 into the gas vent 67. For higher gas pressures, such as would be generated by a bolted short in the protected circuit, the center of the flexible sheet member 23 bows out as shown in FIG. 6, allowing the higher pressure gases to escape more easily into the gas vent 67. A barrier 69, which could be made, for instance, from fish paper, prevents the discharge arc gas from entering the terminal recess 61.

While the arc chute 1 of the invention has been shown as applied to a circuit breaker 47, it will be appreciated that it could also be used in other electric power switches in which arc gases are generated in order to provide controlled relief of the gas pressure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc chute for an electric power switch that generates arc gases upon opening, the arc chute comprising:

an arc chamber structure having at least one gas opening for release of arc gases; and a valve comprising:

a flexible sheet member having two ends and side edges extending between the two ends; and mounting means mounting the flexible sheet member at the two ends to the arc chamber structure to extend over and close the at least one gas opening in the absence of arc gases and with at least one of the two ends of the flexible sheet member free to slide along the arc chamber structure and bow the flexible sheet member between the two ends allowing arc gases to pass from the gas opening out laterally between the side edges of the flexible sheet member and the arc chamber structure.

2. The arc chute of claim 1, wherein the mounting means comprises a guide on the arc chamber structure slideably engaging the at least one end of the resilient sheet member to allow the at least one end of the flexible sheet member to slide along the arc chamber structure.

3. The arc chute of claim 2, wherein the mounting means further comprises at least one longitudinal slot through the one end of the flexible sheet member, and the guide on the arc chamber structure slideably engages the at least one longitudinal slot to allow the at least one end of the flexible sheet member to slide toward the other end of the flexible sheet member.

4. The arc chute of claim 3, wherein the mounting means comprises a pair of laterally spaced longitudinal slots through the one end of the flexible sheet member and a pair of guides on the arc chamber structure slideably engaging the pair of longitudinal slots to allow the one end of the flexible sheet member to slide toward the other end of the flexible sheet member.

5. The arc chute of claim 1, wherein the mounting means comprises a pair of laterally spaced longitudinal slots through each of the two ends of the flexible sheet member and a pair of guides on the arc chamber structure slideably engaging the pair of longitudinal slots at each of the two ends of the flexible sheet member to allow each of the two ends of the flexible sheet member to slide toward the other end and bow the flexible sheet member between the two ends for passage of arc gases from the gas opening in the arc chamber structure laterally outward between the side edges of the flexible sheet member and the arc chamber structure.

6. The arc chute of claim 5, wherein the arc chamber structure comprises at least two arc plates, each having a pair of spaced apart extensions projecting outward to form one of the pairs of guides.

7. The arc chute of claim 6, wherein the flexible sheet member has at least one slit registering at least in part with the at least one gas opening forming a at least one flap deflected by arc gas passing through the at least one gas opening allowing escape of the arc gas.

8. The arc chute of claim 7, wherein the flexible sheet member has at least two intersecting slits at least partially registering with the at least one gas opening to form multiple flaps that are deflected by arc gas passing through the at least one gas opening allowing escape of the arc gas.

9. The arc chute of claim 8, wherein the multiple flaps are deflected to allow arc gas to escape before the flexible sheet member bows substantially to allow arc gas to pass laterally out between the side edges of the flexible sheet member and the arc chamber structure.

10. The arc chute of claim 1, wherein the flexible sheet member has at least one slit registering at least in part with the at least one gas opening forming a flap deflected by arc gas passing through the at least one gas opening allowing escape of the arc gas.

11. An electric power switch comprising:

a casing having a gas vent;

separable contacts mounted in the casing; and an arc chute positioned in the casing between the separable contacts and the gas vent and comprising:

an arc chamber structure having a gas opening; and a valve comprising:

a flexible sheet member having two ends and side edges extending between the two ends; and mounting means mounting the flexible sheet member at the two ends to extend over and close the gas opening in the absence of arc gases and with at least one end of the flexible sheet member free to slide as the flexible sheet member bows between the two ends and lifts up the side edges between the two ends allowing arc gases from the at least one gas opening to pass laterally outward between the side edges of the flexible sheet member and the arc chamber structure and out through the gas vent in the casing.

12. The electric power switch of claim 11, wherein the mounting means mounts the flexible sheet member with each of the two ends free to slide.

13. The electric power switch of claim 12, wherein the mounting means comprises a pair of longitudinal slots through the flexible sheet member at each of the two ends, and two pairs of guides on the arc chamber structure each slideably engaging one of the pairs of longitudinal slots to allow each end of the flexible sheet member to slide along the arc chamber structure.

14. The electric power switch of claim 13, wherein the arc chute structure comprises a pair of sidewalls and a plurality of arc plates extending in spaced relation between the pair of sidewalls, a pair of the arc plates each have a pair of extensions forming one of the pairs of guides.

15. The electric power switch of claim 11, wherein the mounting means comprises at least one longitudinal slot through the one end of the flexible sheet member and at least one guide on the arc chamber structure slideably engaging the at least one slot.

16. The electric power switch of claim 15, wherein the arc chute structure comprises a pair of sidewalls and a plurality of arc plates extending in spaced relation between the pair of sidewalls, and at least one arc plate has an extension forming the at least one guide.

17. The electric power switch of claim 11, wherein the flexible sheet member has at least one slit forming at least one flap that deflects to allow arc gas to pass.

18. The electric power switch of claim 17, wherein the at least one flap formed by the at least one slit deflects to allow some arc gas to pass before the flexible sheet member bows substantially.

19. The electric power switch of claim 18, wherein the flexible sheet member has at least two intersecting slits forming multiple flaps that deflect under gas pressure.

* * * * *